US005293920A

United States Patent [19]

Vagedes

[11] Patent Number: 5,293,920

[45] Date of Patent: Mar. 15, 1994

[54] LOUVERED BASEMENT VENT

[76] Inventor: Michael Vagedes, 677 Sunnybrook Dr., Florence, Ky. 41042

[21] Appl. No.: 88,781

[22] Filed: Jul. 8, 1993

[51] Int. Cl.[5] ..... F24F 7/00

[52] U.S. Cl. ..... 160/89; 160/104; 454/221; 454/224; 49/371; 52/198; 52/302.1; 52/473

[58] Field of Search ..... 52/473, 198, 302.1, 52/302.3; 160/89, 104; 454/221, 224; 49/90.1, 371

[56] References Cited

U.S. PATENT DOCUMENTS

| | | | |
|---|---|---|---|
| 732,809 | 7/1903 | Zborowski | 454/224 X |
| 2,092,673 | 9/1937 | Kempf | 160/104 X |
| 2,135,750 | 11/1938 | Harding | 160/104 |
| 2,216,413 | 10/1940 | Jones | 49/90.1 X |
| 2,220,405 | 11/1940 | Jones | 49/90.1 X |
| 2,531,499 | 11/1950 | Brown | 49/90.1 X |
| 2,549,314 | 4/1951 | Kegley | 49/371 |
| 2,759,573 | 8/1956 | Schwab | 49/371 |
| 3,220,079 | 11/1965 | Aggson | 52/302.3 |
| 4,911,066 | 3/1990 | Carew | 52/473 X |

*Primary Examiner*—Carl D. Friedman
*Assistant Examiner*—Robert J. Canfield

[57] ABSTRACT

A basement vent includes a frame and a screened opening. A plurality of louvers cover said frame. The louvers each include tabs which slide within slots in the frame. The tabs each include a detent section that permit the louvers to be held in an open position for use in the summer months and permit the louvers to be closed during the winter months.

5 Claims, 2 Drawing Sheets

LOUVERED BASEMENT VENT

BACKGROUND OF THE INVENTION

It is a common practice for buildings with subgrade level, enclosed spaces such as crawl spaces and/or basements to provide venting. This permits moisture to escape from the basement during warm summer months. However, it is generally unnecessary to vent these spaces during the colder winter months when the air is dryer and less moisture is seeping into the basement. Accordingly, it is preferable to close off these vents during the winter months.

To close off vents for the winter, it is generally necessary to place a cover over the vent opening. Although this is not particularly difficult, it is very easy to lose the cover. Even if the vent cover is not lost, one must store it while not in use. Also, it does generally take more time than desired to cover the vent and subsequently uncover it during the summer months.

SUMMARY OF THE INVENTION

It is an object of the present invention to provide a basement vent which has a covering for the opening which remains in place year round. It is further an object of the present invention to provide a louvered basement vent wherein the louvers cover the opening of the vent and are pivotally attached to the vent. These louvers include a means to prop the louvers open during the summer months and permit them to be pivoted and closed during the winter months. The louvered vent of the present invention includes louvers which have a tab which slide into slots in the vent frame. The tabs include a detent portion which acts to hold the louvers in an open position for venting purposes but still allow movement of the louvers from a closed position.

The objects and advantages of the present invention will be further appreciated in light of the following detailed description and drawings in which:

DETAILED DESCRIPTION

Figure 1:
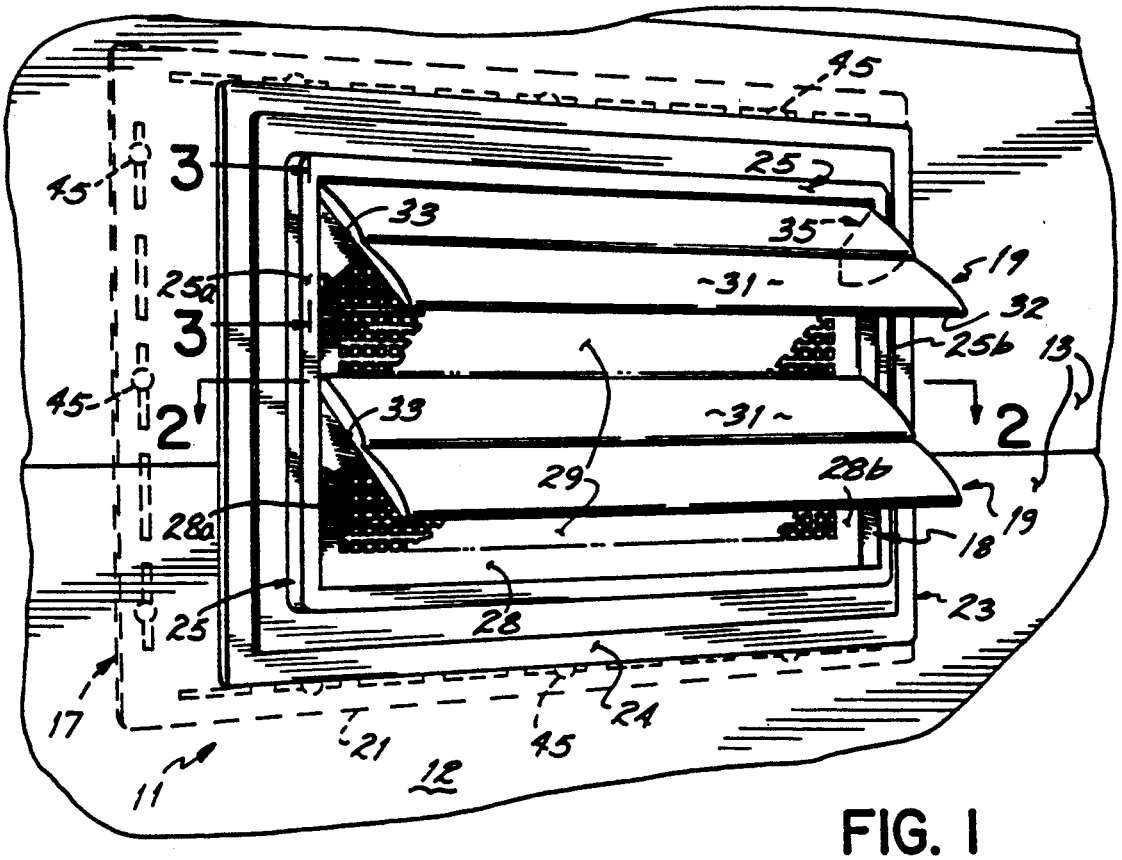
FIG. 1 is a perspective view of a house having a vent according to the present invention.
Figure 2:
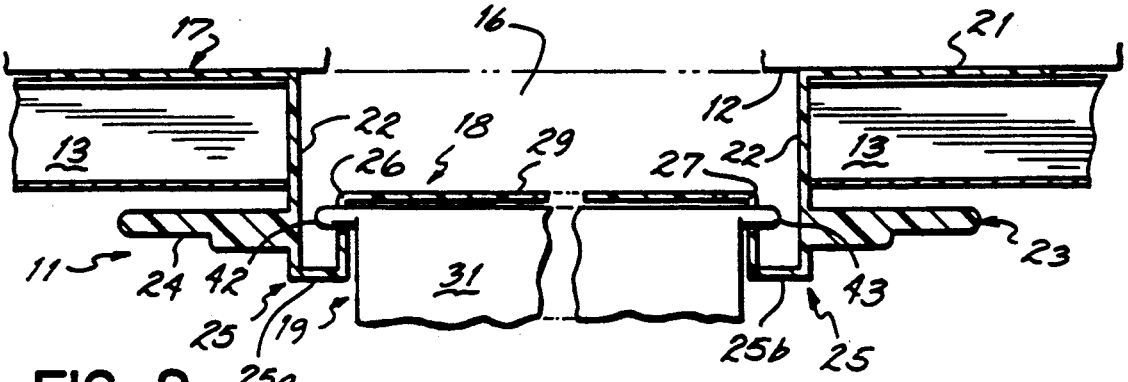
FIG. 2 is a cross-sectional view taken at lines 2—2 of FIG. 1 of the vent of the present invention.
Figure 3:
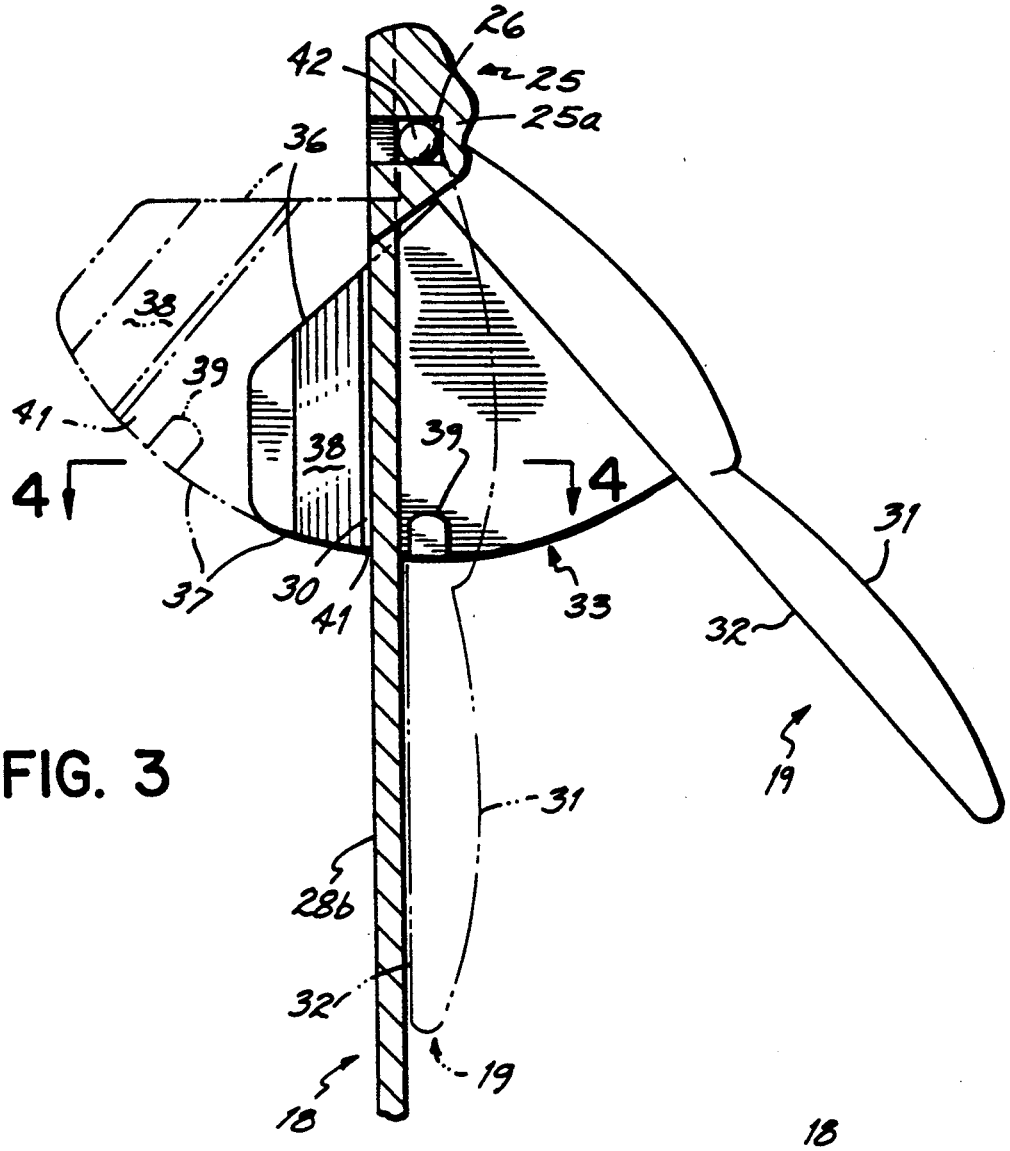
FIG. 3 is a cross-sectional view taken at lines 3—3 of FIG. 1.
Figure 4:
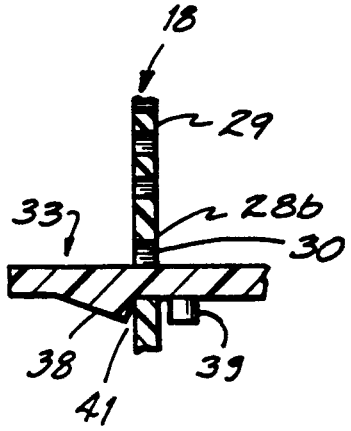
FIG. 4 is a cross-sectional view taken at lines 4—4 of FIG. 3.

The present invention is a basement vent 1 1 which, as shown, is nailed to the side 12 of a house which is in turn covered with siding 13. The vent itself includes a rectangular frame 17 which has an opening 16 covered by a screen portion 18 in turn covered by louvers 19.

The frame 17 includes a base, mounting, or nailing flange 21. Extended from the base flange 21 is a rectangular neck portion or wall portion 22 which extends to outer rectangular flange 23. This neck portion 22 defines the opening 16 through frame 17. The outer flange 23 lies parallel to the base flange 21. The outer rectangular flange 23 extends around the screened portion 18. A peripheral ridge 25 runs along the upper surface 24 of outer flange 23. The left and right sides 25*a* and 25*b* of the peripheral ridge 25 include corresponding holes 26 and 27.

The screened portion 18 which covers the opening 16 in the frame 17 includes a solid peripheral portion 28 and a central screened portion 29 which permits air to flow in and out of the opening 16 through the frame 17. On the left and right side portions 28*a* and 28*b* of the solid peripheral portion 28 are four slots 30, two aligned on each side.

The louvers 19 include a front side 31 and a back side 32. Left and right tabs 33 and 35 extend at a 90° angle from the back side 32. The tabs 33 and 35 include an upper edge 36 which extends at about 90° from the backside 32 and a lower curved edge 37 which extends likewise from the back surface. Each tab includes one sloped ridge 38 and a boss 39 with a valley 41 between them. Each louver 19 includes left and right pins 42 and 43. The left and right side pins 42 and 43 extend into the holes 26 and 27 in the ridge 25. Since the width of the louvers is about equal to the distance between the left and right sides 25*a* and 25*b* of ridge 25, the pins will hold the louvers in position. The tabs 30 and 35 fit into slots 30 in peripheral portion 28 of screened cover 18. This permits the louvers to pivot about pins 41 and 42 with the tabs sliding within the slots 30.

Preferably, the vent of the present invention is made from a relatively flexible material and is preferably injection molded polypropylene. Thus, the vent itself is relatively flexible so that when the louvers 19 are pivoted outward boss 39 on the tabs 33 and 35 will engage the side wall 28 of the slot 30. This can be manually bent slightly until the boss 39 passes beyond the slot 30 and the wall 28 ends up in the valley 41 between ridge 38 and boss 39. This will maintain the louver open at about a 45° angle.

In the wintertime, the louver is simply pushed inwardly and the weight of the louver will keep it generally in a closed position. With the louvers closed, the screened portion 18 is completely covered. In this closed position, the louvers can freely rotate (about 30°) to a partially opened position until the boss 39 engages the wall 28. Thus, if there is positive pressure in the interior of the building, air will flow out the vent.

To install the vent of the present invention, the vent is centered over an opening (not shown) in the wall 12 of a house. Nails 45 are hammered through slots in the base flange 21. Siding 13 is then installed abutted against neck 22 so that the edge of the siding is concealed by the outer flange 23. The vent can then be used by simply pulling the louvers up or pushing them down.

The vent of the present invention can be modified so that it can be attached to a house in a variety of different manners other than that nail strip specifically shown. For example, it could telescope within an opening of a wall or could snap fit to another piece of conduit which extends through the wall.

Accordingly, the invention should not be limited to the particular means of attachment to the house or in any other manner except as claimed in the appended claims wherein I claim:

1. A basement vent having a frame and a screened opening;

a plurality of louvers covering said screened opening wherein the louvers each include tabs which slide within slots which extend through said frame from a front of said frame to a back of said frame;

said tabs each include a detent section which engage said slots to hold a louver in an open position for use in the summer months wherein said tabs can slide into said slots to permit the louvers to be closed during the winter months and wherein said louvers can freely rotate from a closed position to a partially opened position.

2. A basement vent comprising a frame having an opening;

a plurality of louvers pivotally attached to said frame and covering said opening;

said frame having a plurality of slots which extend through said frame from a front of said frame to a back of said frame and wherein each of said louvers includes a tab which sides within one of said slots in said frame;

wherein at least one of said tabs has a detent adapted to engage an edge of one of said slots to keep a louver pivoted in an open position.

3. The basement vent claimed in claim 2 wherein said detent comprises raised portions separated by a valley.

4. The basement vent claimed in claim 3 wherein said frame includes a peripheral ridge, said peripheral ridge including laterally spaced holes wherein each louver includes two opposed lateral pins pivotally mounted within said holes.

5. The basement vent claimed in claim 4 wherein said frame includes a mounting flange and a peripheral neck extending up from said mounting flange, said peripheral neck tending to an outer flange wherein said peripheral ridge runs along said outer flange.

* * * * *